US007628022B2

(12) United States Patent
Spoor et al.

(10) Patent No.: US 7,628,022 B2
(45) Date of Patent: Dec. 8, 2009

(54) ACOUSTIC COOLING DEVICE WITH COLDHEAD AND RESONANT DRIVER SEPARATED

(75) Inventors: Philip S. Spoor, Waterford, NY (US); John A. Corey, Melrose, NY (US)

(73) Assignee: Clever Fellows Innovation Consortium, Inc., Troy, NY (US)

( * ) Notice: Subject to any disclaimer, the term of this patent is extended or adjusted under 35 U.S.C. 154(b) by 302 days.

(21) Appl. No.: 11/552,186

(22) Filed: Oct. 24, 2006

(65) Prior Publication Data

US 2007/0095074 A1 May 3, 2007

(51) Int. Cl.
*F25B 9/00* (2006.01)

(52) U.S. Cl. ..... 62/6

(58) Field of Classification Search ..... 62/6
See application file for complete search history.

(56) References Cited

U.S. PATENT DOCUMENTS 4,722,201 A * 2/1988 Hofler et al. ..... 62/467
4,953,366 A * 9/1990 Swift et al. ..... 62/467
5,177,971 A * 1/1993 Kiyota ..... 62/6
5,515,685 A * 5/1996 Yanai et al. ..... 62/6
6,021,643 A * 2/2000 Swift et al. ..... 62/6
6,263,677 B1 * 7/2001 Hafner et al. ..... 62/6
6,397,605 B1 * 6/2002 Pundak ..... 62/6
6,412,290 B1 * 7/2002 Okumura et al. ..... 62/55.5
6,604,363 B2 * 8/2003 Corey et al. ..... 62/6
6,658,862 B2 * 12/2003 Swift et al. ..... 62/6
6,938,426 B1 * 9/2005 Acharya et al. ..... 62/6
7,434,409 B2 10/2008 Gedeon
2005/0061006 A1 * 3/2005 Bonaquist et al. ..... 62/6

* cited by examiner

*Primary Examiner*—William C Doerrler
(74) *Attorney, Agent, or Firm*—Hoffman Warnick LLC

(57) ABSTRACT

An acoustic cooling device is provided. A coldhead and an acoustic power source of the acoustic cooling device are separated by way of a long tube connecting them to enable the cold tip to be installed in a remote location where a traditional unitary system would not fit, would generate too much vibration, or would be otherwise undesirable. The dimensions of the tube and the relevant parameters of the acoustic power source are selected to keep the system resonant at the desired drive frequency (e.g., 60 Hz) and to minimize the impact of the long tube on the system efficiency and capacity.

28 Claims, 2 Drawing Sheets

ACOUSTIC COOLING DEVICE WITH COLDHEAD AND RESONANT DRIVER SEPARATED

FIELD OF THE INVENTION

The invention relates generally to high-frequency Stirling and acoustic Stirling coolers, and more particularly, to a solution for an acoustic cooling device with a coldhead and an acoustic power source separated.

BACKGROUND OF THE INVENTION

In recent years, high-frequency (≧30 Hz) Stirling and acoustic Stirling (or high-frequency "pulse-tube") coolers have attracted much commercial interest because of their higher efficiency, lower maintenance, and lower noise and vibration as compared to rival technologies. One of the chief disadvantages of high-frequency Stirling coolers, however, is that the set of thermally active components (heat rejector, regenerator, and heat acceptor or "cold tip"), often referred to as the "coldhead," is typically very intimate with the source of acoustic power that drives it. This source is usually a pressure wave generator (PWG), including one or more linear motors coupled to pistons that alternately compress and expand the working gas at the warm end of the coldhead.

On the other hand, spatial separation of coldhead and acoustic power drive permits the use of acoustic Stirling cooling in applications where space near the region to be cooled is a premium, and/or where vibration at the cold tip must be minimized. Efforts have been made to separate a coldhead and an acoustic drive. However, current technology allows only minimal separation of the drive and the coldhead, for example, the LPT9310 Stirling cooler by Thales Cryogenics BV. None of the current technologies has allowed a separation distance substantially greater than the characteristic dimension of a power wave generator, or of a substantial fraction of an acoustic wavelength (measured at operating frequency). All previous approaches use very narrow-diameter transfer lines, presumably to minimize the volume added by the transfer line, as required especially by Stirling coolers with displacer mechanisms in the coldhead, driven by the pressure wave in the working gas and demanding minimal 'dead' or unswept volume to preserve that driving effect. This structure tends to make the gas velocity in the tube very high, necessitating a short length to minimize the visco-acoustic losses on the tube walls. Only one patent, U.S. Pat. No. 5,794,450 (Arthur Ray Alexander), mentions the use of transfer lines to separate the PWG and the coldhead of an acoustic Stirling system for a remotely driven "pulse tube" cooler or an array of coolers. However, in Alexander, the transfer lines are much less than a wavelength in length and on the order of the pressure-wave generator dimensions. In addition, Alexander teaches a loop system, where the phase-shifting network (the acoustic equivalent of a displacer mechanism in a conventional Stirling), connected to the cold-side of the regenerator, is also connected to the PWG as a source of fluid, suggesting that a circulating, not just oscillating, flow is anticipated. Alexander is also specifically limited to the field of cooling electronic components.

One patent application publication US 20050210887, to Arman, describes a split system with the acoustic driver and coldhead separated by a transfer line for purposes of vibration isolation.

The pressure-wave generators used in acoustic Stirling coolers are often referred to as "compressors" but are not to be confused with the more familiar kind that take a steady stream of gas at a low, constant pressure and compress it to a higher constant pressure. That type of compressor is found in rival cooling technologies such as Gifford-McMahon coolers or vapor-compression refrigerators. The advantage of that type of compressor and the coolers that use them, is that the compressor and the coldhead or cold heat exchanger can be very remote from each other, with the length of separation having relatively little impact on system performance. The working fluid simply flows unidirectionally through a connecting tube or duct at low, constant velocity, incurring very little pressure drop in the process. A Stirling or acoustic-Stirling system, by contrast, is very sensitive to the size of a volume or length of a duct connecting main components because the entire system must be dynamically resonant, and every component experiences significant oscillating pressure and/or oscillating flow.

A long coupling tube which is a significant fraction of a wavelength will shift the system's resonant frequency, change the impedance seen by the pistons in the pressure-wave generator, and experience non-negligible acoustic power loss on the tube surface. At 60 Hz, the wavelength of sound in helium gas at 300K is about 17 meters; the oscillating pressure and particle velocity go through their maximum variation in a quarter wavelength, so in order to avoid wavelength effects, the length of a transfer line must be kept much shorter than a quarter wavelength. To avoid significant impacts on the stroke of the PWG motors or the PWG's natural frequency, the transfer line's total volume must also be minimized. For these reasons, Stirling and acoustic-Stirling coldheads in split systems always have had transfer lines that are extremely narrow in diameter and relatively short, ≦50 cm long for systems that run at or near 60 Hz.

To this extent, a need exists for a solution for an acoustic cooling device with a coldhead and an acoustic power source separated by a distance that is not necessarily short compared to a wavelength. This extends the usefulness of a high-frequency acoustic Stirling cooler to applications where a relatively large separation distance is required or desired.

SUMMARY OF THE INVENTION

An acoustic cooling device is provided. A coldhead and an acoustic power source of the acoustic cooling device are separated by way of a long tube connecting them to enable the cold tip to be installed in a remote location where a traditional unitary system would not fit, would generate too much vibration, or would be otherwise undesirable. The dimensions of the tube and the relevant parameters of the acoustic power source are selected to keep the system resonant at the desired drive frequency (e.g., 60 Hz) and to minimize the impact of the long tube on the system efficiency and capacity.

A first aspect of the invention provides an acoustic cooling device, the cooling device comprising: an acoustic power source; and a first acoustic cooling head, wherein the acoustic power source and the first acoustic cooling head are connected by a first transfer line, a length of the first transfer line being at least 0.15 of a quarter wavelength in a working fluid at an operating frequency.

A second aspect of the invention provides a chilled storage system, the chilled storage system comprising: a chamber; and a cooler comprising an acoustic power source and a first acoustic cooling head connected by a first transfer line, wherein the first acoustic cooling head is in thermal communication with an interior of the chamber, and the acoustic power source is remotely located outside the chamber.

The illustrative aspects of the present invention are designed to solve the problems herein described and other problems not discussed, which are discoverable by one skilled in the art.

BRIEF DESCRIPTION OF THE DRAWINGS

These and other features of the invention will be more readily understood from the following detailed description of the various aspects of the invention taken in conjunction with the accompanying drawings that depict various embodiments of the invention, in which.

It is noted that the drawings are not to scale. The drawings are intended to depict only typical aspects of the invention, and therefore should not be considered as limiting the scope of the invention. In the drawings, like numbering represents like elements between the drawings.

DETAILED DESCRIPTION

The present invention includes an acoustic cooling device with a working fluid at an operating frequency of approximately 60 Hz. The acoustic cooling device uses a transfer line which may be several meters long, and may contain total gas volume several times larger than the gas volume in a coldhead of the acoustic cooling system. Furthermore, the acoustic cooling device may be optimized to have efficiency close to or equal to that of an equivalent unitary system. This design is not possible in the existing systems because the addition of so much volume would cause the pressure wave generator to overstroke before useful pressure-wave amplitudes were reached, unless the transfer line were made extremely narrow, in which case the resulting high acoustic velocity in the transfer line would cause prohibitively high acoustic losses (hence the narrow, short transfer lines in all existing commercial systems).

What enables the present invention is a creative new understanding of the relevant relationships among components in an acoustic cooling system. It is known that the adiabatic volume in a PWG is not necessarily optimum when it is minimized. Rather, the piston diameter can be chosen to accommodate a given adiabatic volume, and the two can be chosen to guarantee that the motors in a PWG will execute their ideal stroke (e.g., for maximum efficiency) when producing the necessary pressure wave for a given load. (See Corey et al., U.S. Pat. No. 6,604,363.) If that load includes a long transfer tube of non-negligible volume, it may require that the pistons be enlarged to accommodate it. Conventional thinking would conclude that this would result in lower efficiency due to the increased piston seal perimeter and associated losses. The present invention recognizes that this may not be the case, due to complementary effects. For instance, an acoustic coldhead preferably has a pressure antinode, or a region of maximum acoustic pressure, at or near the center of the regenerator. The farther one obtains from the regenerator, up to a quarter wavelength, the lower the acoustic pressure amplitude. Because the dissipation (losses) in a clearance seal is proportional to the acoustic pressure squared, the seal loss (at the pistons, remote from the regenerator) may be, overall, lower with a long transfer line, even if the pistons are larger, but at a position of lower acoustic pressure than the regenerator. This may offset some of the losses that occur in the transfer line itself.

Figure 1:
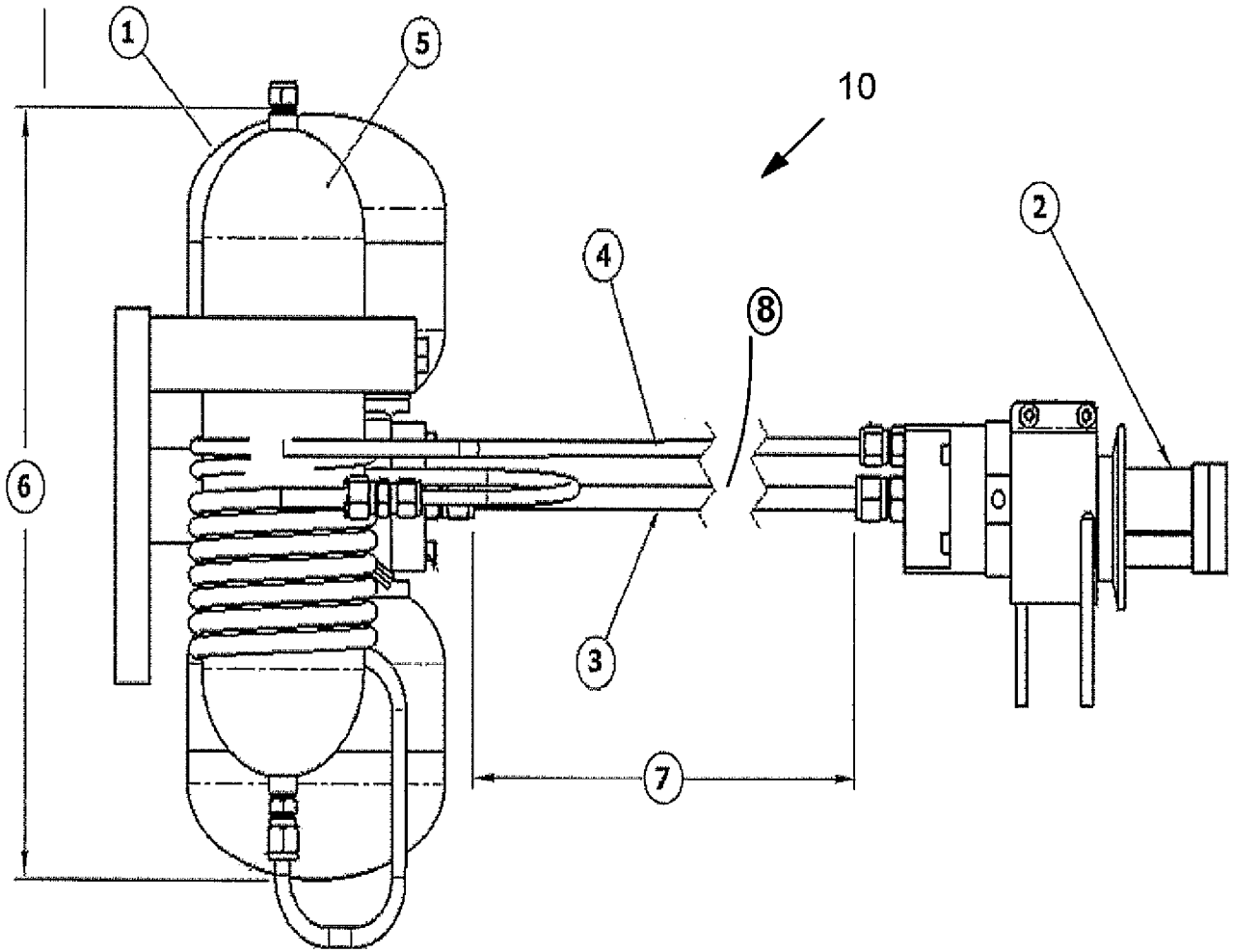
FIG. 1 shows a pressure wave generator with a remote coldhead according to one embodiment of the invention.

With reference to the figures, one embodiment of the invention will be described here. It should be understood that the invention is not limited to the embodiment described. FIG. 1 shows an acoustic cooling device 10 including an electrically-driven pressure-wave generator (PWG) 1 with a remote coldhead 2 according to one embodiment of the present invention. As shown in FIG. 1, PWG 1 is connected to coldhead 2 by means of a long flexible transfer line 3. Coldhead 2 is substantially insensitive to orientation. A portion of an inertance tube 4 is located along transfer line 3. Coldhead 2 is in turn connected by means of inertance tube 4 to a reservoir, e.g., compliance tank 5. Transfer line 3 has a length (7) that is, according to one embodiment, approximately 125 cm, over four times the longest PWG dimension (6) of approximately 31 cm. The frequency of a working fluid (not shown) is approximately 60 Hz and the fluid is helium, so the transfer line 7 is about 0.3 of a quarter wavelength (here 4.25 meters). A transfer line that is more than 0.15 of a quarter wavelength is considered a significant fraction of the quarter wavelength. An inner diameter 8 of transfer line 3 is selected based on a piston size (not shown) and an adiabatic volume (not shown) of PWG 1 to maximize overall efficiency. In the embodiment shown in FIG. 1, transfer line (3) inner diameter (8) is approximately 0.80 cm, and its total volume (not shown) is approximately 61 cubic centimeters (cc). Cooling device 10 may further include a cooling fluid (not shown) for rejecting heat from coldhead 2. In one embodiment, a portion of the cooling fluid is conducted along transfer line 3. For maximum convenience, transfer line 3 may be enclosed with any of inertance tube 4 and conduits for cooling fluid (not shown) in a common protective shroud extending between PWG 1 and coldhead 2, including flexible lines (3) comprising inner corrugations and outer braided coverings, as are known in the art. Inertance tube 4 and the conduits for cooling fluid (not shown) may be co-routed with transfer line 3.

In this embodiment, a volume of all the gas in coldhead 2 (excluding inertance tube 4 and compliance tank 5) is less than approximately 37 cc, so transfer line 3 in this embodiment has considerably more gas volume than coldhead 2.

Figure 2:
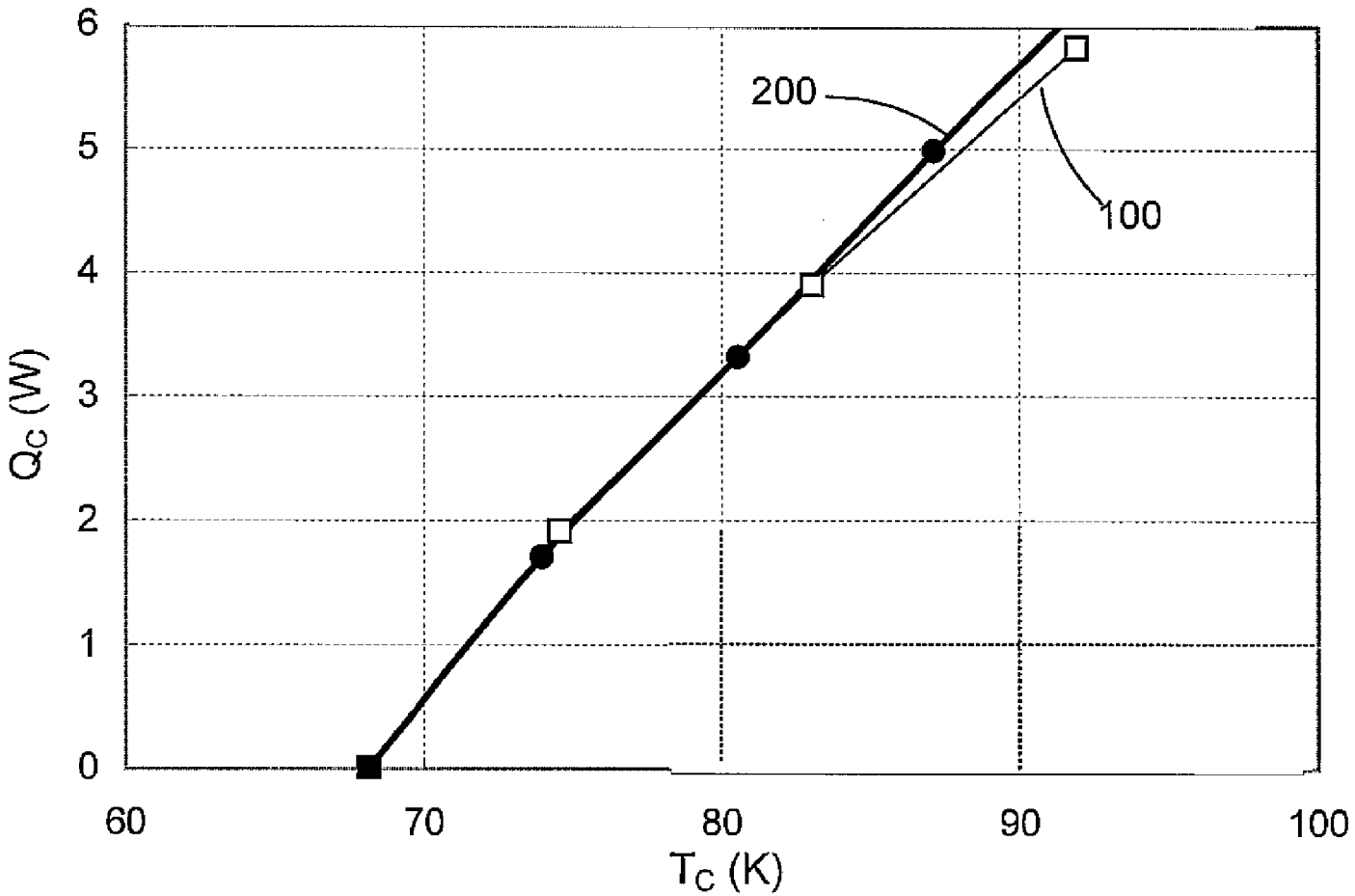
FIG. 2 shows performance of a split acoustic-Stirling cooler according to one embodiment of the invention compared to an equivalent unitary system.

FIG. 2 shows the performance of an acoustic cooling device 10 (FIG. 1) according to one embodiment of the present invention (shown by line 100), versus that of an equivalent unitary system (shown by line 200). The unitary system uses the same PWG and coldhead as the acoustic cooling device 10 (FIG. 1) of the current invention, but does not include a transfer line. As shown in FIG. 2, the performances of the two systems are nearly identical, which shows that, against conventional expectation, a long transfer line does not have to be a significant penalty on cooler performance when designed correctly.

It should be understood that the scope of the current invention is not limited to the above-described embodiment, and the current invention provides various alternative embodiments. For example, according to one alternative embodiment, an acoustic cooling device may further include more than one coldheads and more than one transfer line. Each coldhead is connected to a (shared) PWG by a transfer line, and each transfer line is (connected in) parallel to one another. According to one embodiment, the more than one coldheads and the more than one transfer lines are unequal in length and volume. In another embodiment, inertance tube 4 and an associated reservoir (not shown) are part of the coldhead (2) assembly, so that inertance tube 4 does not extend from the coldhead 2 to the PWG 1 as it does in FIG. 1.

In still another embodiment, an acoustic cooling device includes at least two coldheads. One of the coldheads is connected to a PWG by a transfer line and the other cooling head is mounted directly to the PWG.

In still another embodiment, a chilled storage system includes a chamber and an acoustic cooling device as described above. An acoustic cooling head is in thermal communication with an interior of the chamber, and the acoustic power source is remotely located outside the chamber.

It should be understood that generally, for any given transfer line or plethora of lines connecting to coldheads, the piston size and adiabatic volume of PWG 1 (FIG. 1) can be chosen to guarantee system resonance at the desired frequency and adequate stroke to reach the desired pressure wave amplitude at coldhead 2 (FIG. 1). The present invention recognizes that if a certain transfer line length is desired, transfer line diameter together with PWG adiabatic volume and piston size can be chosen to not only guarantee proper resonance frequency and sufficient piston stroke, but also to minimize the impact of the transfer line on the system performance.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to an individual in the art are included within the scope of the invention as defined by the accompanying claims.

What is claimed is:

1. An acoustic Stirling cooling device with a working fluid oscillating at an operating frequency, the cooling device comprising:

an acoustic power source; and a first acoustic cooling head, wherein the acoustic power source and the first acoustic cooling head are connected by a first transfer line, a length of the first transfer line being at least 0.15 of a quarter wavelength in the working fluid at the operating frequency.

2. The cooling device of claim 1, wherein a volume of fluid in the first transfer line is at least half of that in the first acoustic cooling head.

3. The cooling device of claim 1, wherein a diameter of the first transfer line is selected based on a piston size and an adiabatic volume of the acoustic power source to maximize overall efficiency.

4. The cooling device of claim 1, further comprising a second different transfer line and a second different acoustic cooling head, the second different acoustic cooling head connected to the acoustic power source by the second different transfer line, wherein the second different transfer line is connected in parallel to the first transfer line.

5. The cooling device of claim 4, wherein the second different acoustic cooling head and the second different transfer line are unequal to the first acoustic cooling head and the first transfer line in at least one of length and volume.

6. The cooling device of claim 1, further comprising a second different acoustic cooling head that is mounted directly to the acoustic power source.

7. The cooling device of claim 1, wherein the first transfer line is flexible.

8. The cooling device of claim 1, further comprising an inertance tube, a portion of the inertance tube being located along the first transfer line.

9. The cooling device of claim 8, further comprising a reservoir associated with the inertance tube, wherein the inertance tube and the reservoir are integral with the coldhead.

10. The cooling device of claim 1, further comprising a cooling fluid for rejecting heat from the first acoustic cooling head, a portion of the cooling fluid being conducted along the first transfer line.

11. The cooling device of claim 10, further comprising an inertance tube, wherein at least one of the following: a conduit for the cooling fluid and the inertance tube are routed with the transfer line within a common protective enclosure.

12. The cooling device of claim 1, wherein the first acoustic cooling head is substantially insensitive to orientation.

13. The cooling device of claim 1, wherein the acoustic power source is an electrically-driven acoustic source.

14. The cooling device of claim 1, wherein the acoustic power source is a thermally-driven acoustic source.

15. A chilled storage system, the chilled storage system comprising:

a chamber; and an acoustic Stirling cooling device with a working fluid oscillating at an operating frequency, the acoustic cooling device including an acoustic power source and a first acoustic cooling head connected by a first transfer line, a length of the first transfer line being at least 0.15 of a quarter wavelength in the working fluid at the operating frequency;

wherein the first acoustic cooling head is in direct thermal communication with an interior of the chamber, and the acoustic power source is remotely located outside the chamber.

16. The chilled storage system of claim 15, wherein a volume of a fluid in the first transfer line is at least half of that in the first acoustic cooling head.

17. The chilled storage system of claim 15, wherein a diameter of the first transfer line is selected based on a piston size and an adiabatic volume of the acoustic power source to maximize overall efficiency.

18. The chilled storage system of claim 15, further comprising a second different transfer line and a second different acoustic cooling head, the second different acoustic cooling head connected to the acoustic power source by the second different transfer line, wherein the second different transfer line is connected in parallel to the first transfer line.

19. The chilled storage system of claim 18, wherein the second acoustic cooling head and the second transfer line are unequal to the first acoustic cooling head and the first transfer line in at least one of length and volume.

20. The chilled storage system of claim 15, further comprising a second different acoustic cooling head that is mounted directly to the acoustic power source.

21. The chilled storage system of claim 15, wherein the first transfer line is flexible.

22. The chilled storage system of claim 15, further comprising an inertance tube, a portion of the inertance tube being located along the first transfer line.

23. The chilled storage system of claim 22, further comprising a reservoir associated with the inertance tube, wherein the inertance tube and the reservoir are integral with the coldhead.

24. The chilled storage system of claim 15, further comprising a cooling fluid for rejecting heat from the first acoustic cooling head, a portion of the cooling fluid being conducted along the first transfer line.

25. The chill storage system of claim 24, further comprising an inertance tube, wherein at least one of the following: a conduit for the cooling fluid and the inertance tube are routed with the transfer line within a common protective enclosure.

26. The chilled storage system of claim 15, wherein the first acoustic cooling head is substantially insensitive to orientation.

27. The chilled storage system of claim 15, wherein the acoustic power source is an electrically-driven acoustic source.

28. The chilled storage system of claim 15, wherein the acoustic power source is a thermally-driven acoustic source.

* * * * *

UNITED STATES PATENT AND TRADEMARK OFFICE

CERTIFICATE OF CORRECTION

PATENT NO. : 7,628,022 B2
APPLICATION NO. : 11/552186
DATED : December 8, 2009
INVENTOR(S) : Spoor et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 347 days.

Signed and Sealed this

Second Day of November, 2010

David J. Kappos

David J. Kappos
*Director of the United States Patent and Trademark Office*